US006098837A

United States Patent [19]

Izawa et al.

[11] Patent Number: 6,098,837

[45] Date of Patent: Aug. 8, 2000

[54] NOTE HOPPER/DISPENSER

[75] Inventors: Hikaru Izawa; Kensuke Matsunaga; Yoshiaki Uemizo, all of Osaka, Japan

[73] Assignee: Japan Cash Machine Co., Ltd., Osaka, Japan

[21] Appl. No.: 09/046,857

[22] Filed: Mar. 24, 1998

[51] Int. Cl.[7] ..... A47F 1/04

[52] U.S. Cl. ..... 221/154; 902/13

[58] Field of Search ..... 221/2, 7, 97, 197, 221/154, 151; 271/145, 10.08, 34, 149, 31.1; 902/9, 13, 14, 17

[56] References Cited

U.S. PATENT DOCUMENTS

| | | | |
|---|---|---|---|
| 4,325,277 | 4/1982 | Uchida et al. . | |
| 4,447,097 | 5/1984 | Lafevers et al. | 902/13 |
| 5,105,364 | 4/1992 | Kawamura et al. | 902/13 |

FOREIGN PATENT DOCUMENTS

| | | |
|---|---|---|
| 84304323 | 6/1984 | European Pat. Off. . |
| 9211593 | 9/1992 | European Pat. Off. . |
| 2410998 | 9/1975 | Germany . |
| 2305763 | 4/1997 | United Kingdom . |

*Primary Examiner*—Kenneth W. Noland
*Attorney, Agent, or Firm*—Bachman & LaPointe, P.C.

[57] ABSTRACT

A note hopper/dispenser for dispensing paper currency, bank notes or cash equivalent scrip.

13 Claims, 9 Drawing Sheets

NOTE HOPPER/DISPENSER

FIELD OF THE INVENTION

The present invention is generally directed to the field of currency handling machines, and in particular to a note hopper for dispensing paper currency, bank notes or cash equivalent scrip.

BACKGROUND OF THE INVENTION

The advent of wide-spread use of bill acceptors or currency validation units for use with gaming machines and vending machines has greatly increased the convenience to the user by allowing the use of paper bills in various denominations, as opposed to coins, to operate these types of machines. Generally, however, these types of machines only dispenses money in the form of coins and they are incapable of dispensing paper currency. Coincidentally, the wide-spread use of automated transaction machines (ATMs) has provided the consuming public with ready access to paper currency from ATMs using a bank card or credit card and upon entry of user appropriate code information. Operationally, however, ATMs are predominantly intended to dispense currency in a single denomination from a secure location and they are thus little more than a note counting and dispensing apparatus.

For certain applications, such as gaming and vending machines having bill validation capabilities, there is a need for a bill or note dispenser which will interact with an electronic controller of the machine, to dispense currency, bills, or other secure notes.

SUMMARY OF THE INVENTION

The present invention is directed to a note hopper which holds and dispenses paper currency, bank notes, coupons, scrip, or other "secure" paper with an associated cash value. The note hopper may be incorporated into a host machine, such as a gaming machine, vending machine or cash box. The note hopper preferably includes a microprocessor based controller which can be connected to an electronic controller of the host machine.

The note hopper has two primary component subassemblies, herein being referred to as the note cassette and the transport assembly. The note cassette is a removable, replaceable storage device to hold, in a secure fashion, a supply of paper currency, or alternative cash equivalent paper scrip to be dispensed. The transport assembly includes the mechanical and electrical components to allow the paper currency to be extracted from the note cassette, transported, and dispensed in response to instructions by the microprocessor based electronic controller. The note hopper also incorporates the electronic circuits necessary to allow for secure communication of instruction or commands, as well as to monitor and provide status messaging, to the electronic controller of the host machine.

DETAILED DESCRIPTION OF THE PREFERRED EMBODIMENT

The present invention is directed to a note hopper 10, which may be incorporated into a host machine 12. The note hopper 10 stores and dispenses paper currency, bank notes or "secure" paper such as printed coupons or scrip. Such currency is conveniently dispensed from note hopper 10, so that it may be accepted by a user. The note hopper 10 is controlled by electronic instructions from the host machine 12. When non-currency secure paper is to be dispensed, such paper preferably incorporates in its design and/or manufacture, characteristics to allow it to be scrutinized and validated by bill validators and other electronic currency validation, stacking and sorting devices.

Figure 1:
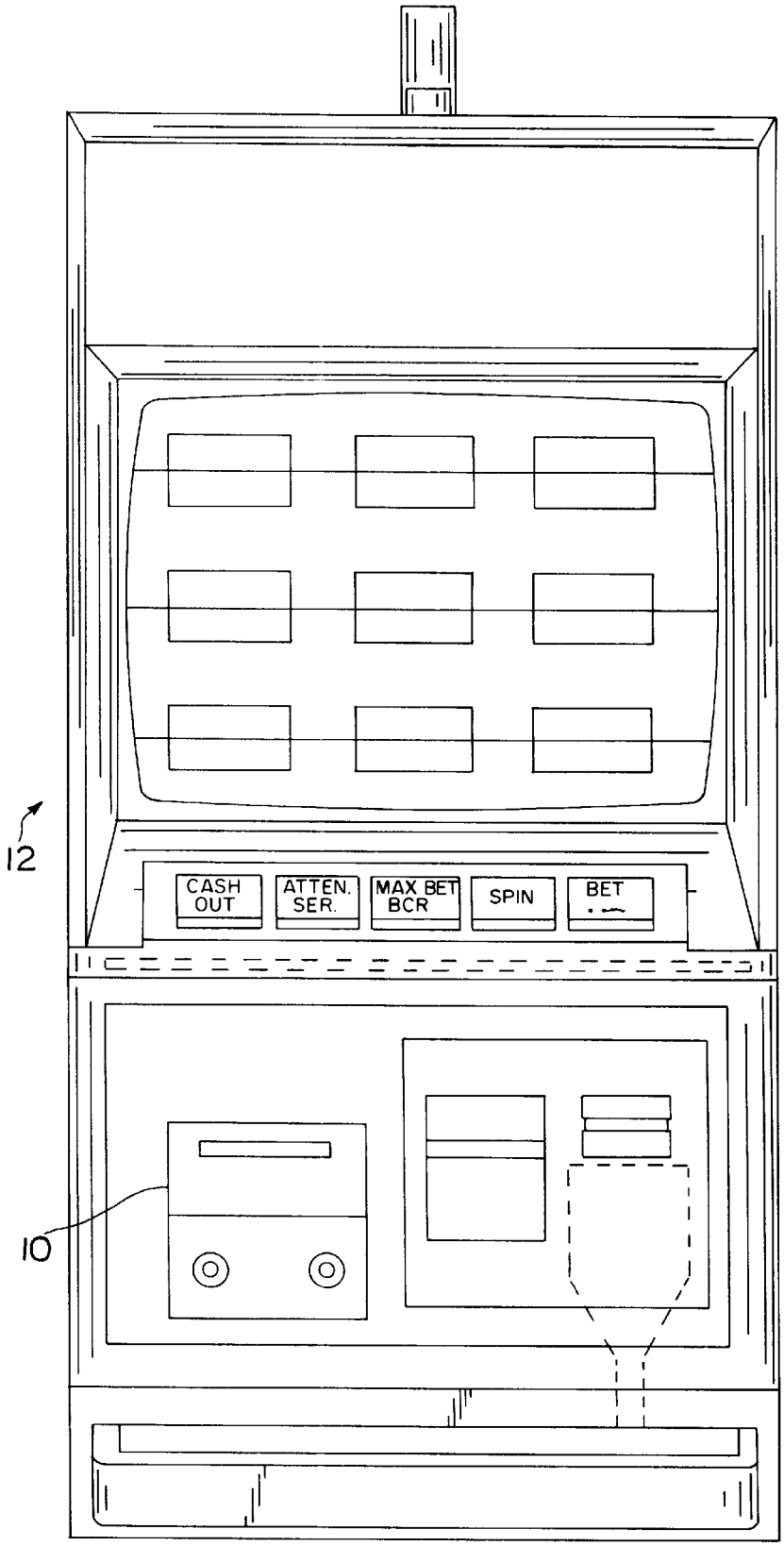
FIG. 1 depicts the note hopper of the present invention incorporated into a host machine.
Figure 2:
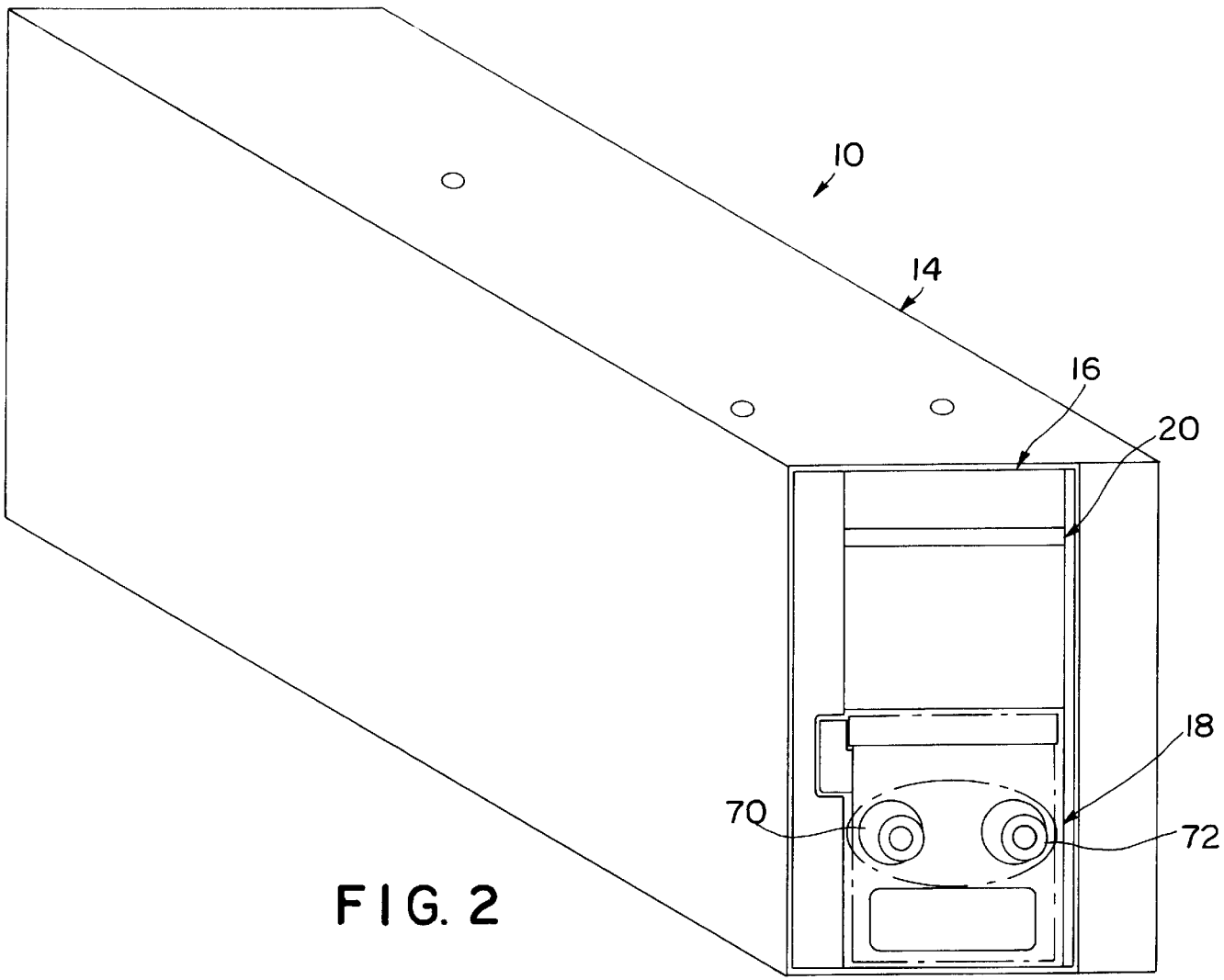
FIG. 2 is a perspective view of the note hopper of FIG. 1 removed from the host machine.

FIG. 2 depicts a prospective view of the note hopper 10 of FIG. 1 removed from the host machine 12. The note hopper 10 includes a chassis 14 designed to be secured on or into the host machine 12. The chassis 14 contains a transport assembly 16 and a currency cassette 18, as shown removed from the chassis 14 in FIGS. 3 and 4, respectively.

Figure 3:
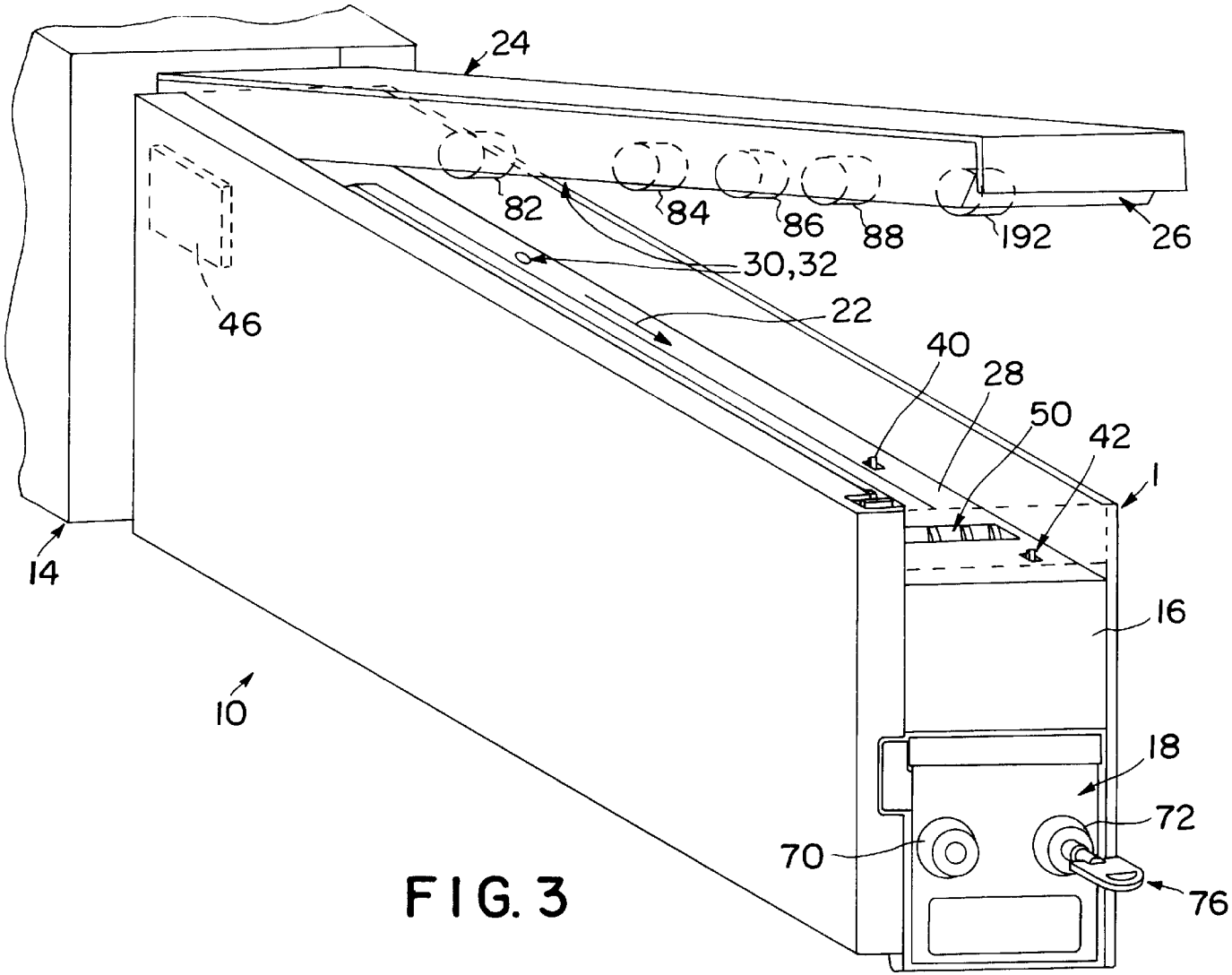
FIG. 3 is a partially exploded view of the note hopper of FIG. 2 illustrating details of the transport assembly of the note hopper.

As depicted in FIG. 2 and in the view of FIG. 3, the transport assembly 16 includes a slot 20 from which currency can be dispensed. The slot 20 for dispensing currency is the opening at the end of a transport path 22 defined by a drive transport assembly 24 which generally comprises a lid assembly 26 and a transport shelf 28. The lid assembly 26 and transport shelf 28 may include one or more sensors 30, 32, such as magnetic or preferably optical infra red sensors, for detecting identifying characteristics of bills and notes and authenticating each bill or note which is to be dispensed.

The transport assembly 16 includes "double-bill" check and bill validity detection systems to assure that each bill or note is authentic and is dispensed individually. In the event that a double bill detection event occurs, the transport assembly 16 diverts the double bill to a storage area in the note hopper 10, by redirecting the travel path of the double bill so that it is not dispensed.

The transport shelf 28 may also include lever sensor 40, to detect the passage and position of the bill or note within the transport assembly 16. In addition, the transport shelf 28 may include a lever sensor 42, which operates to provide a signal to prevent dispensing of a subsequent note prior to removal of a preceding note.

The optical sensors 30 and 32, lever sensors 40 and 42 and the drive mechanisms or motors are coupled to and electronically controlled by an electronic controller 46 within the note hopper 10. The electronic controller 46 also provides all control functions and allows communications with the host machine 12 (FIG. 1).

As depicted in FIG. 3, the transport shelf 28 also includes a diverter slot 44 which provides an opening to a reject note path 48 for allowing a double bill or other type of rejected note to be stored in the note hopper 10.

Figure 4:
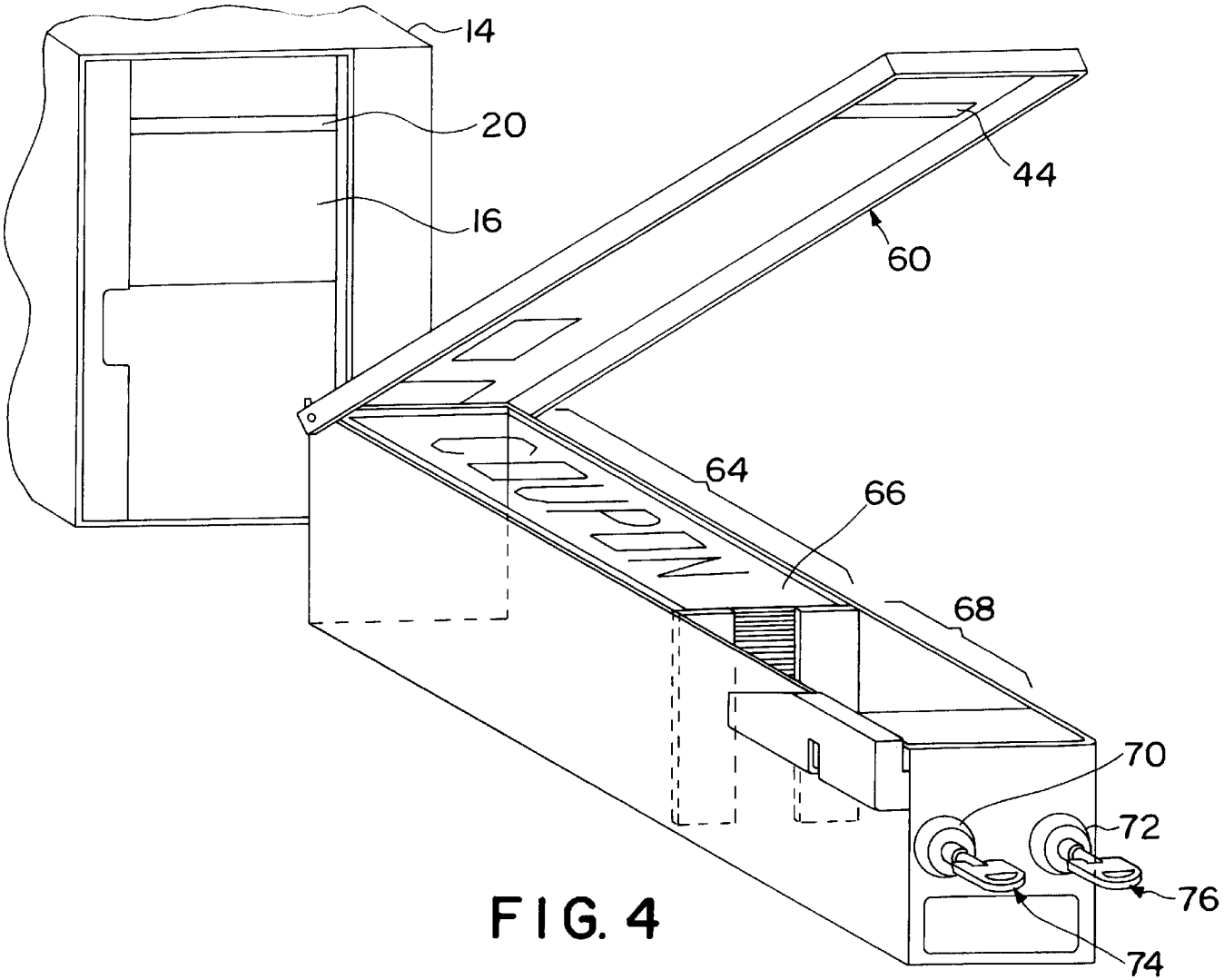
FIG. 4 is a perspective view of the currency cassette of the note hopper extracted from the transport assembly of FIG. 3.

FIG. 4 depicts a perspective view of the currency cassette 18 extracted from the transport assembly 16. The currency cassette 18 includes a lid 60 attached to a frame 62. The frame 62 includes a currency storage hopper 64 which allows the storage of a plurality of coupons, currency, notes or bills 66. At the front portion of the currency cassette 18 is a rejected note storage area 68 which is positioned below the diverter slot 44 of the transport shelf 28 upon installation of the currency cassette 18 into the transport assembly 16.

Preferably, the currency cassette includes double lock assemblies 70 and 72. A double lock configuration allows the first lock assembly 70 to be used to secure the currency cassette 18 within the transport assembly 16, while the second lock assembly 72 secures the lid 60 to the frame 62 to thereby secure access to notes held in the currency cassette 18 when it is removed from the transport assembly 16. The double lock assembly also preferably requires two keys 74 and 76 respectively, to open the currency cassette 18 and allow access to the currency storage area 64.

The note hopper 10 would be conventionally incorporated inside of an electronically controlled host machine 12 (FIG. 1) to allow dispensing of paper currency. The note hopper 10 is designed to dispense notes or currency of a predetermined denomination. In operation, the transport assembly 16 extracts bills from the currency cassette 18, verifies that only one bill has been extracted by sensing characteristics of the bill via optical sensors 30 and 32, and sequentially dispenses the bills through slot 20. The note hopper 10 can be configured such that "secure" paper such as coupons or scrip, having exchangeable monetary value, can be dispensed. Such secure paper 66 would preferably be designed to be inserted into and recognized by compatible currency accepter or bill validator machines.

Figure 5:
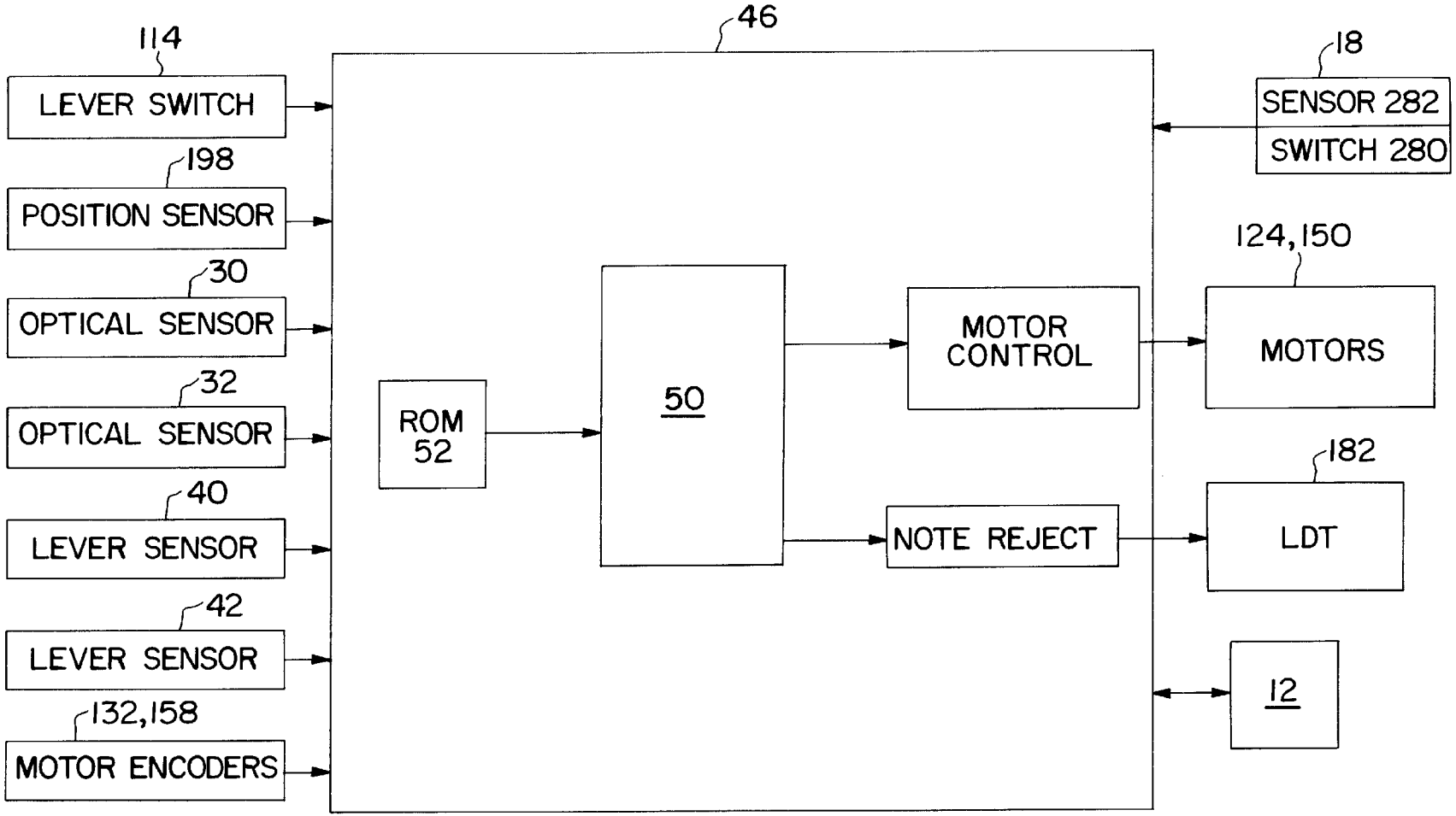
FIG. 5 is a block diagram of the electronic control system of the note hopper of the present invention.

FIG. 5 is a block diagram which schematically shows the microprocessor controller 46 for the note hopper 10 of the present invention. At the heart of the microprocessor controller 46 is a microprocessor 50. The microprocessor 50 relies upon programming instructions stored in a code read-only memory (ROM) 52, in which is stored programming and execution instructions. The microprocessor 50 of the note hopper 10, may also be connected to an electronic controller for a host machine including a bill validator so that the components can share control functions relating to the validation proceedings for bills and notes.

Figure 6:
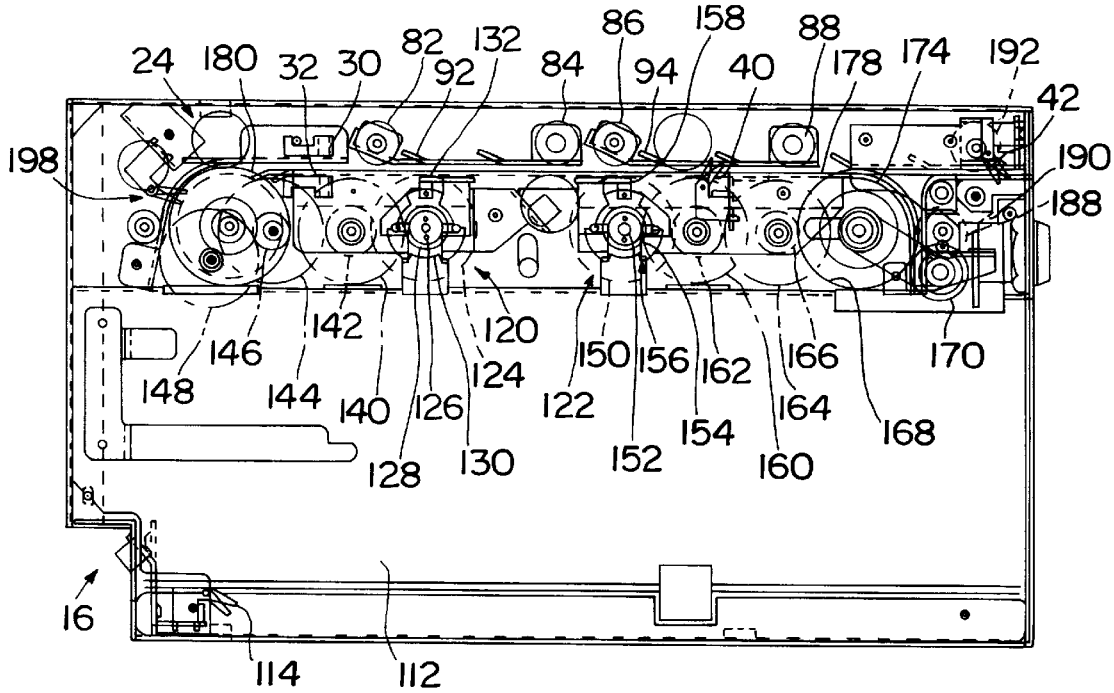
FIG. 6 is a cross sectional side view of the transport assembly of FIG. 3.
Figure 7:
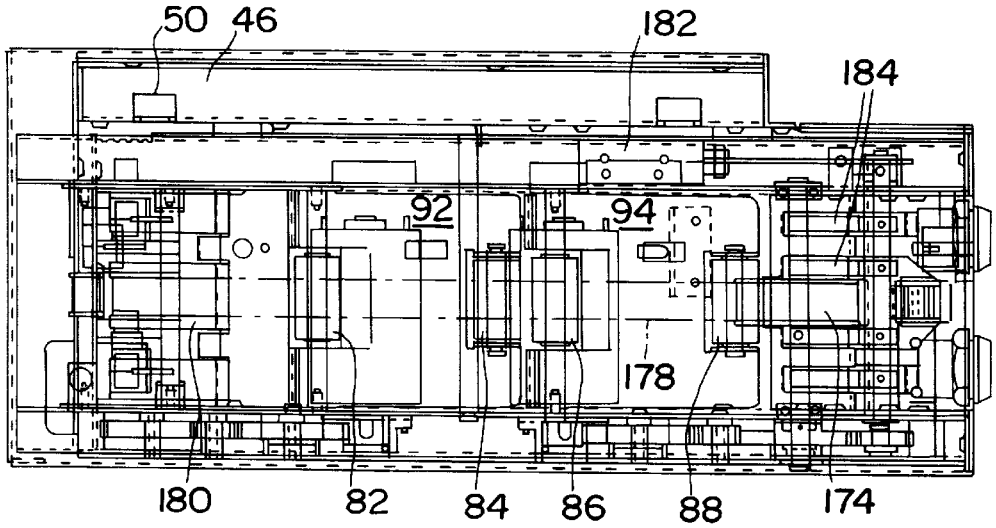
FIG. 7 is a cross sectional top view of the transport assembly of FIG. 3.

FIGS. 6 and 7 depict detailed cross-sectional left side and top views, respectively, of the transport assembly 16 of FIG. 3, and particularly the components of the drive transport assembly 24 thereof. In the cross-sectional left side view of FIG. 6, the currency cassette 18 has been removed from the transport assembly 16. The currency cassette 18 is intended to be placed in a cassette bay 112, located in the lower portion of the transport assembly 16. The transport assembly 16 includes a "cassette installed" lever switch 114 as depicted near the bottom left corner, which produces an electric signal to confirm to the electronic controller 46 that the currency cassette 18 is positioned within the currency bay 112.

Referring to FIGS. 6 and 7, the drive transport assembly 24 of the transport assembly 16 includes a note extraction drive assembly 120 and a note advance assembly 122. The note extraction drive assembly 120 provides the driving elements in order to drive a gear located within the currency cassette 18 which in turn drives a roller to advance a bill out of the currency cassette 18 and into the transport path 22 of the transport assembly 16. The note advance assembly 122, by comparison, provides a belt drive system to engage the note once it enters the transport path 22 and advance the note either to the slot 20 or to and through diverter slot 44 into the reject note storage area 68.

The note extraction drive assembly 120 includes a motor 124 which includes a shaft 126 on which is mounted both a drive gear 128 and a rotating position indicator 130. The rotating position indicator 130 is sensed by a motor encoder sensor 132 which provides an output signal to the electronic controller 46 indicative of the rotational position of the motor 124 and thereby the rate at which a note is advancing, in order to allow the synchronization of the note advance for purposes of sensor validation of the note information by the electronic controller 46.

The drive gear 128 drives, through a sequence of speed reducing gears 140, 142, 144 and 146, a driven gear 148. The driven gear 148 extends slightly downward from the bottom portion of the drive transport assembly 24 so that it may engage a gear in the currency cassette 18 described subsequently with respect to FIG. 8.

The note advance drive assembly 122 includes a motor 150 having a shaft 152 on which is mounted a drive gear 154 and a rotational position indicator 156. The rotational position indicator 156 is sensed by a motor encoder sensor 158 which provides output signals to the electronic controller 46 in a manner similar to the motor encoder sensor 132 discussed above.

The drive gear 154 drives, also through a sequence of speed reducing gears 160, 162, 164, 166, a driven gear 168 and an idler gear 170. The driven gear 168 is mounted on a shaft 172 to drive a belt drive wheel 174. The belt drive wheel 174 in turn drives a belt 178 which extends toward the opposite end of the drive transport assembly 24, where it is wrapped about a belt tension roller 180.

As would be seen if viewed from the left side view of FIG. 6, the belt 178 generally rotates in a clockwise direction so that the upper side of the belt 178, advances from the top of belt tension roller 180 to the drive roller 176, and thus from the back of the transport assembly 24 to the front of the transport assembly 24, to drive a note which is positioned above the belt 178 from the back to the front of the transport assembly 24 along the top of the transport shelf 28 and within the transport path 22.

As discussed above, the transport assembly 16 allows the note hopper 10 to direct an invalid bill or note to a reject note storage area 68 in the currency cassette 18. In order to extract an invalid bill from the transport path 22, a linear displacement transducer 182 actuates a set of diverter levers 184 which are positioned before the end of the transport path 22. During normal operation, the linear displacement transducer 182 is powered on to hold the set of diverter levers 184 down, so that a bill can pass along the transport path 22 to slot 20. If a double note is detected, power to the linear displacement transducer 182 is shut off, and a spring 186 biases the diverter levers 184 to rotate into a position whereby they cause an advancing note to rotate along the inner surface diverter levers 184 and the outer surface of the belt drive wheel 174, while driven by belt 178, so that instead of advancing horizontally out through the slot 20, the bill will rotate around the outside of belt drive wheel 174 through a ninety degree angle, and proceed vertically downward through diverter slot 44.

In order to provide positive tracking near the end of the transport path 22 as well as in the reject note path 48, a tension roller 188 is positioned in front of, and in rotational contact with, the belt drive wheel 174. The combination of the tension roller 188 and the frictional contact with the belt 178 will positively advance a bill positioned therebetween. In addition, the tension roller 188 also drives, by rolling contact, a drive roller 190 positioned just inside of slot 20. The drive roller 190 is also in frictional rolling contact with a tension roller 192 mounted so as to be vertically positioned above drive roller 190 within the lid assembly 26.

In order to detect the position of the note as it exits the slot 20, the mechanical lever sensor 42 is located proximally to slot 20. The mechanical lever sensor 42 is electrically connected to the electronic controller 46 to communicate an electric signal indicating when a note dispensed by the note hopper 10 is removed from the slot 20. The electronic controller 46 of the note hopper 10 may be programmed so that the motor 150 will stop when the trailing end of a bill is held between drive roller 190 and tension roller 192, maintaining the mechanical lever sensor 42 in a closed position, so that only one bill is dispensed at a time. Once the bill is removed, the mechanical lever sensor 42 will open, sending a signal to the electronic controller 46, and the motors 124 and 150 can be activated to transport another bill from the currency cassette 18 to slot 20. Thus when it is desired to dispense only one bill at a time, the electronic controller 46 will not direct power to the drive motors 124 and 150 until the mechanical lever sensor 42 moves to an open position indicating that the last dispensed bill has been removed.

The transport assembly 16 also includes the lever sensor 40 positioned along the transport path 22 before the diverter slot 44 but spaced from optical sensors 30, 32 a distance greater than the length of a bill traveling along the transport path 22. The lever sensor 40 provides an indication of the passage of the leading edge of a bill as it advances along the transport path 22. The lever sensor 40 is electrically connected to the electronic controller 46, so that if an invalid or double bill is detected by the optical sensors 30, 32, and identified by the electronic controller 46, its initial contact with lever sensor 40 will cause the electronic controller 46 to activate the bill divert function, shutting off power to linear displacement transducer 182, as discussed above.

The lid assembly 26 further includes a number of tensioning rollers 82, 84, 86, 88 and 192. These tensioning rollers assist in maintaining the bill essentially flat while it advances along the top surface of belt 178 and transport shelf 28. Each of the tensioning rollers is driven by the belt 178, or by the advancement of a bill between the respective tension roller and belt 178. The tension rollers 104 and 108 may be pivotally mounted on roller frames 92, 94, respectively, so that in the event a note gets jammed in the transport path 22, it can be removed by lifting the roller frame 92 or 94 to access the transport path 22.

The lid assembly 26 also includes the optical sensor 30 which cooperates with the oppositely disposed optical sensor 32 mounted in the drive transport assembly 24. The optical sensors 30 and 32 provide electronic signal information to the electronic controller 46 concerning identifying characteristics of the bill being transported between optical sensors 30 and 32 along the transport path 22. The optical sensor information is synchronized with the position and travel speed of the bill by the electronic controller 46 so that a "bill characteristics" signal, comprised of the sensed identifying characteristics for the entire length of the bill, can be obtained for each note or bill 66. In this manner, the electronic controller 46 can compare the bill characteristics signal to one or more sets of bill characteristics parameters stored in the ROM 52 of the electronic controller 46, to discriminate between a valid single note and a double note or a defective note.

In the instance where the optical sensors 30 and 32 provide a signal which indicates to the electronic controller 46 that a double note is being passed through the transport path 22, or that the note is for some reason invalid, the diverter levers 184 are activated so that the note will be diverted into the reject note storage area 68, as discussed above, and another note is extracted from note cassette 18, validated and dispensed.

The lid assembly 26 also further includes the mechanical position sensor 198 which senses the beginning and trailing edges of the note 66 as it advances proximate the beginning of the transport path 22 within the drive transport assembly 24. The mechanical position sensor 198 is electrically connected to the electronic controller 46 to provide electrical signal output information thereto. In this manner, and in combination with the motor encoder sensors 132 and 158 for the motors 124 and 150, respectively, the optical sensors 30 and 32 can be precisely controlled in operation over the length of the note as it passes between optical sensors 30 and 32.

Figure 8:
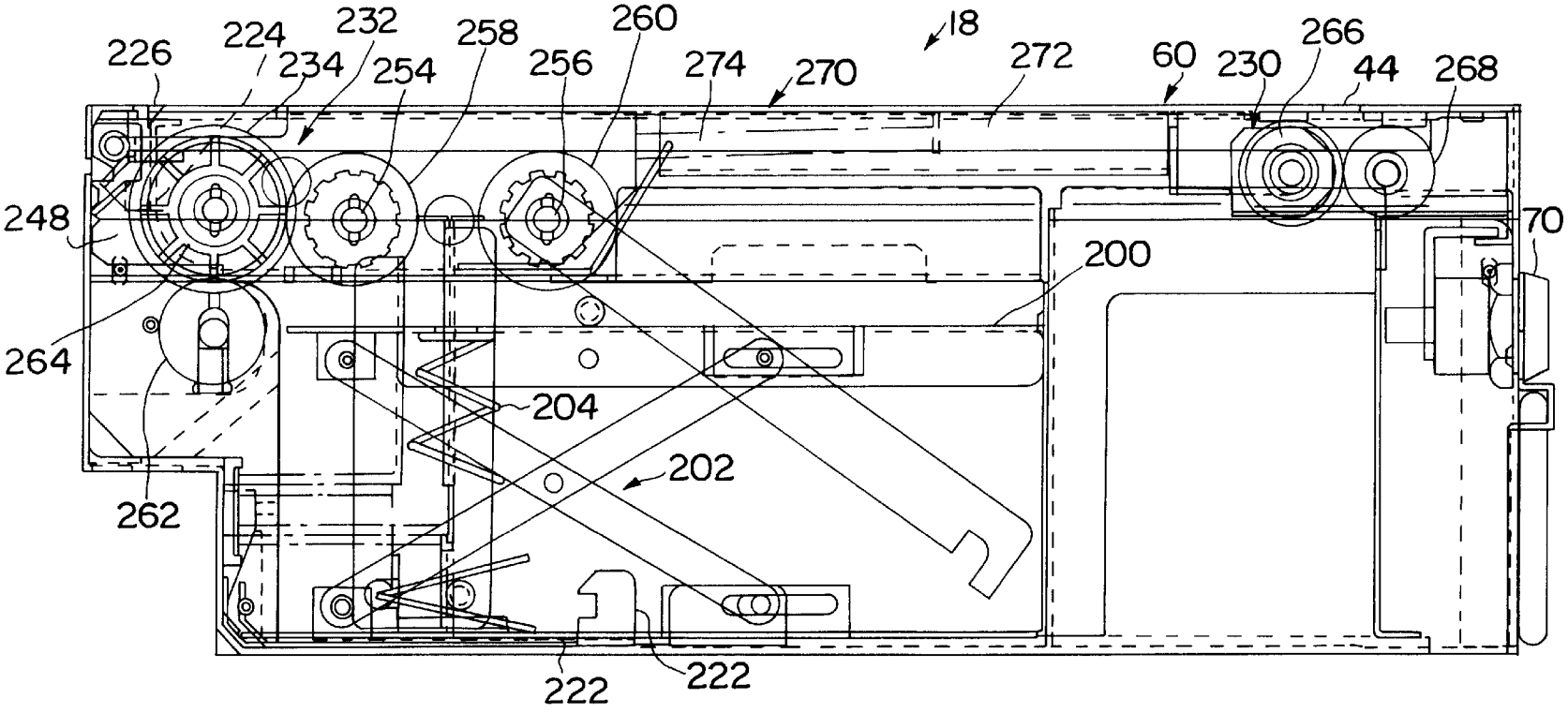
FIG. 8 is a cross sectional side view of the currency cassette of FIG. 4.
Figure 9:
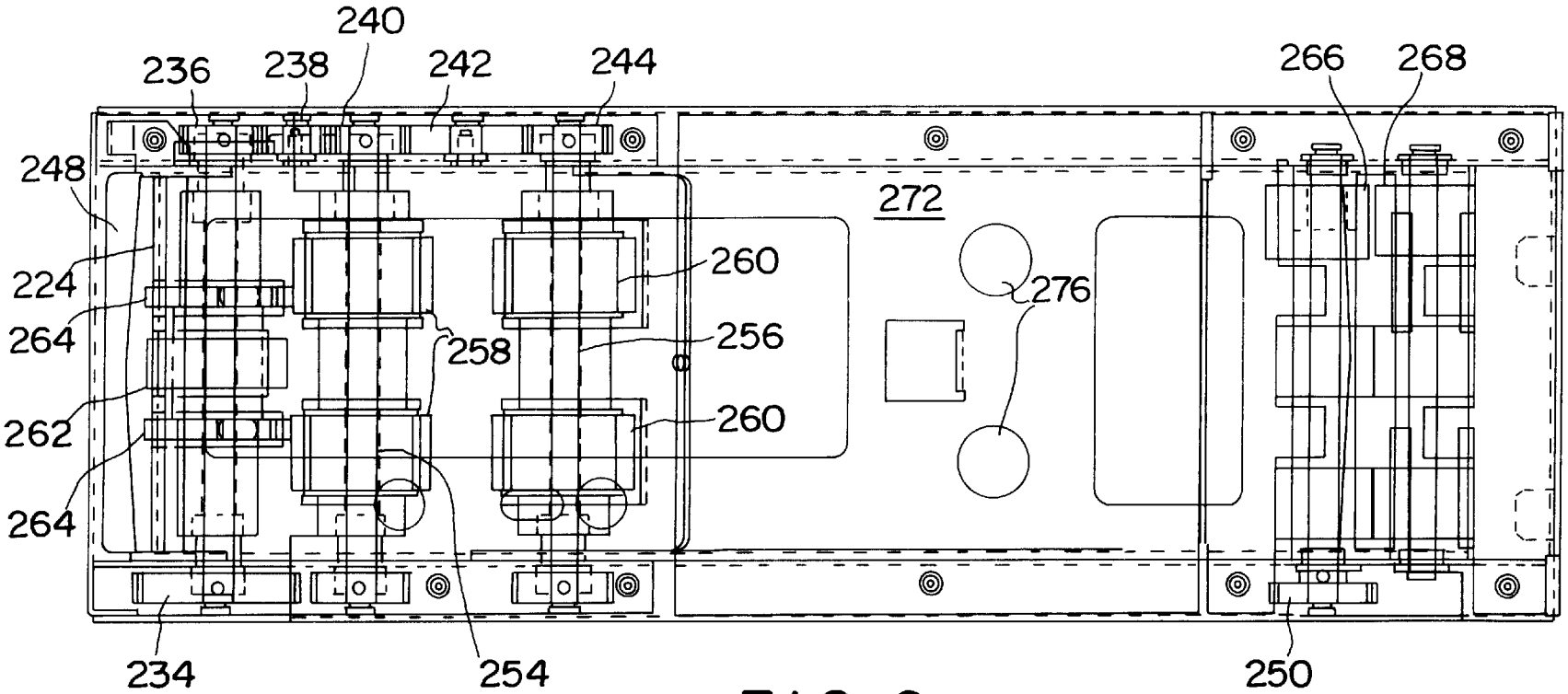
FIG. 9 is a cross sectional top view of the currency cassette of FIG. 4.

FIG. 8 depicts a detailed side cross-sectional view of the currency cassette 18 removed from the transport assembly 16. FIG. 9 depicts a detailed top cross-sectional view of the currency cassette 16. As depicted in FIG. 8 in the operating position, the currency cassette 18 includes the lid 60 that is attached to the top of the frame 62 covering the currency storage hopper 64 and reject note storage area 68.

As depicted in FIGS. 8 and 9, the currency cassette 18 includes a tray 200 for supporting a plurality of coupons, currency, notes, or bills 66 located inside the currency storage hopper 64. The tray 200 is attached to a support assembly 202, which is configured to support the tray 200 through vertical translation while also maintaining the tray 200 horizontally flat. The support assembly 202 is upwardly biased by a spring mechanism 204. The currency cassette 18 also includes a tray release latch 220 that is located on the bottom of the currency storage hopper 64, to allow the tray 200 to be latched at its vertically lowest position to allow notes to be place in the currency storage hopper 64. The tray release latch 220 is connected to a sliding plate 222 which extends to the rear surface of frame 62, so that it engages the transport assembly 16 when the currency cassette 18 is inserted therein, to cause the tray release latch 220 to unlatch and release the tray 200. The spring mechanism 204 will then bias tray 200 vertically upward until the top bill contacts the lid 60.

The currency cassette 18 further includes a note-extract assembly 232 located in the lid 60. The note-extract assembly 232 includes a driven gear 234 which extends slightly upward from the upper portion of the currency cassette 18 so that it can engage the driven gear 148 located on the bottom portion of the drive transport assembly 24, described above with respect FIG. 6. The driven gear 234 drives, through a sequence of gears 236, 238, 240, 242 and 244, shafts 254 and 256, on which are mounted rollers 258 and 260, respectively, as shown best in FIG. 9. Generally, these rollers may be made of rubber or another suitable material which can engage and force paper currency or notes along a defined pathway.

A pathway guide 248 is attached to frame 62. The pathway guide 248 can be made of a material such as hard plastic and is shaped to have a part-cylindrical surface to direct a note or coupon through a pathway 224 and towards slot 226, where the note would then enter the transport assembly 24.

The currency cassette 18 is intended to provide one bill at a time to the transport assembly 16. Accordingly, the currency cassette attempts to prevent double bills from being extracted by the use of a picker wheel 262 that is rotatably mounted to the frame 62 at the leading edge of pathway guide 248. The circumference of the picker wheel 262 comprises a suitable material for causing friction against the leading edge of a note or bill 66. The picker wheel 262 may be configured to only rotate in one direction, which is opposite the direction of travel of the note.

A note diverter assembly 230 is shown positioned toward the front of the currency cassette 18 and positioned in the lid 60 of currency cassette 18. The note diverter assembly 230 includes a driven gear 250 that engages the idler gear 170 of the transport assembly 24. Driven gear 250 is connected to drive one or more rollers 266 and rollers 268 through rolling contact, respectively, as shown in FIG. 9, for diverting a double bill, or a crumpled or torn bill, to the rejected note storage area 68. Any note or bill that is rejected will pass from the transport assembly 16 to the currency cassette 18 through a slot 218. When the currency cassette 18 is installed in the transport assembly 16, the slot 218 will be positioned vertically below the reject note path 48.

A sealing assembly 270 is slidably disposed within the lid 60, where it is biased into a "closed" position by a spring 274. The sealing assembly 270 includes a metal plate 272 for covering slots 218 and 226 of the lid 60, for security whenever the currency cassette 18 is removed from the transport assembly 16. When the currency cassette 18 is placed inside of the transport assembly 16, the sealing assembly 270 is unlocked through operation of one of the locks 70 and 72. This allows the metal plate 272 in the sealing assembly 270 to slide horizontally and uncover the slots 218 and 226 in the lid 60, thus allowing operation of the bill hopper 10.

The top cross-sectional view of the lid 60 of the currency cassette 18 is shown in greater detail in FIG. 9. The driven gear 234 is shown connected to gear 236 via a shaft. Gear 236 drives gears 238, 240, 242 and 244. The gears 240 and 242 are attached to shafts 254, 256 on which are mounted rollers 258 and 260, formed from an elastomeric substance such as rubber. Also, driven gear 234 is attached to fin gears 264 in order to aid the selection of only the top bill from the stack of bills and to further bill or note advancement. Fin gears 264 include a series of fins, comprising a material such as rubber, which are aligned radially around the circumference of a shaft. The fin gears 264 help ensure that only one bill is selected and advanced along the pathway 24 at a time.

Note diverter assembly 230 is shown in FIG. 9 as comprising driven gear 250 which drives rollers 266 and 268, respectively. The lid 60 may also include openings 276, which allow for visual inspection of the currency storage hopper 64, and bills therein.

The sealing assembly 270 is implemented to cover slots 218 and 226, as well as openings 274 to prevent unauthorized entry into the currency cassette 18.

Figure 10:
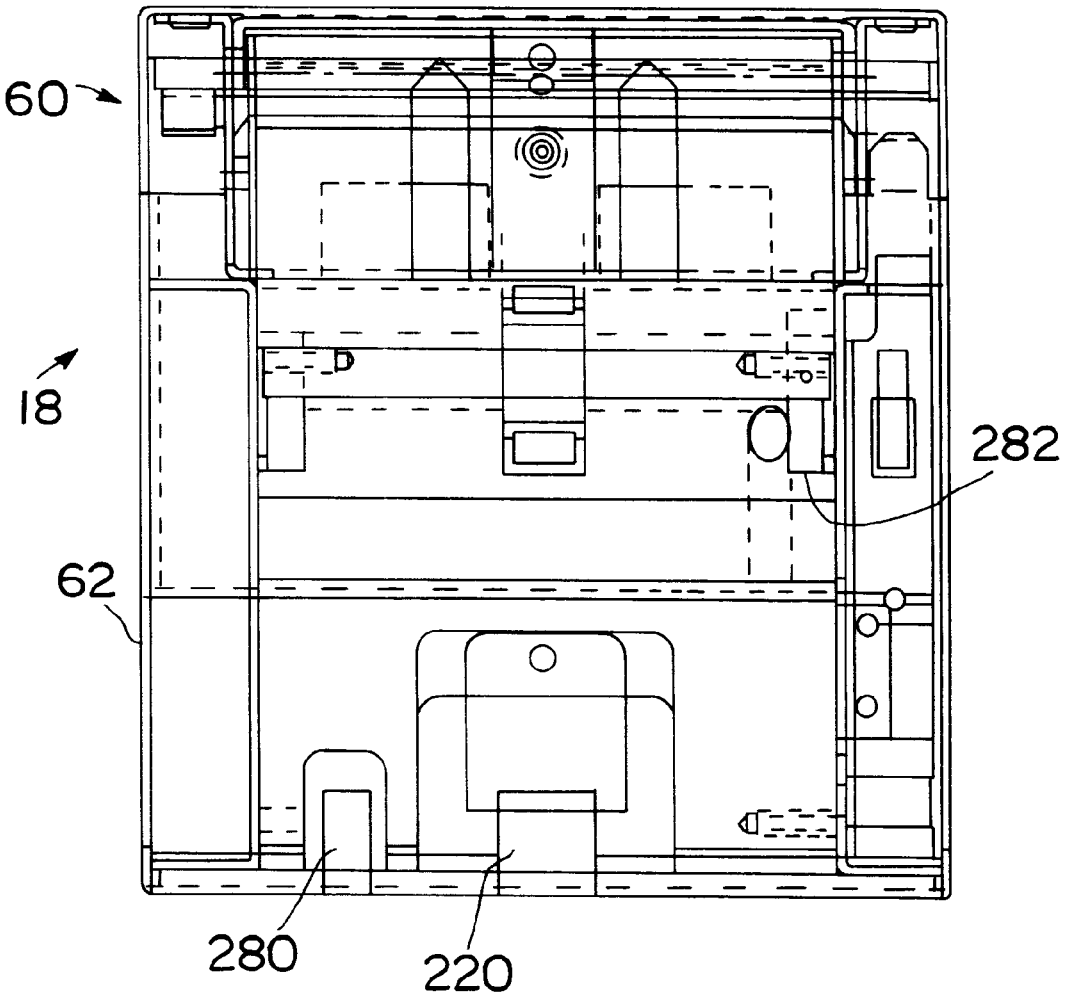
FIG. 10 is a rear view of the currency cassette of FIG. 4.

FIG. 10 depicts a view of the rear surface of the currency cassette 18 and includes the frame 62 and the lid 60. The distal end of the sliding plate 222 for the tray release latch 220, projects from the rear surface. In addition, the rear surface includes a tray empty switch 280, and a near empty optical sensor 282, which are shown on the rear portion of the frame 62.

In operation, a user lifts the lid 60 of the currency cassette 18 and places a plurality of coupons, currency, notes, or bills 66 onto the tray 200 which is depressed until held in place by the tray release latch 220. After the lid 60 is closed, the currency cassette 18 is placed inside the transport assembly 24 which causes the tray release latch 220 to unlatch, thus releasing the tray 200. The spring mechanism 204 then forces the tray 200 upward, causing the uppermost bill 66 to come into contact with the note-extract assembly 232. When a signal is received from the electronic controller 46 of the note hopper 10, the note-extract assembly 232 activates the rollers 258, 260, picker wheel 262 and fingers 264 to advance a single bill or note along pathway 224 to exit the currency cassette 18 at slot 226. Thus, the bill 66 is first advanced along a horizontal path towards the rear section of currency cassette 18. During this transit operation, the picker wheel 262 is designed to prevent more than one note or bill from advancing along the pathway 224. As the leading edge of the bill is slid into the pathway guide 248, the bill is forced by the pathway guide 248 to rotate ninety degrees so that it is directed upward, towards the top of the currency cassette 18 where it exits out of the slot 226 and enters the transport path 22 in the transport assembly 16.

When the mechanical position sensor 198, as shown in FIG. 6, is actuated by the leading edge of the advancing bill, the trailing edge of the bill will have pass beyond rollers 258 and 260. Accordingly, the electronic controller 46 sends a signal shutting off motor 126, so that the note-extract assembly 232 will no longer be actively driven and the rollers 258 and 260 will stop rotating and rest on the next bill. Therefore, the next bill in the stack will be held in place, and will not advance along with the bill being pulled through the transport path 22. In addition, the rollers 258 and 260 will stop rotating as soon as the trailing edge of the bill has advanced from underneath rollers 258 and 260.

By the time the leading edge of the bill extracted from the currency cassette 16 causes the mechanical position sensor 198 to move to the closed position, the leading edge of the bill has come into contact with the belt 178 which is being driven by drive motor 150. The motor encoder sensor 158 associated with the rotating position indicator 156 for motor 150 provides a signal to the electronic controller 46 which can be interpreted to determine the exact speed of the translation of the bill along the transport path 22. Thus, the electronic controller 46 will be able to determine when the leading edge of the bill 66 reaches the optical sensors 30 and 32. During the time that the bill passes length wise between optical sensors 30 and 32, the bill would be moving at a constant speed so that bill characteristic data produced by the outputs of sensors 30 and 32 may be communicated to the electronic controller 46 in accordance with the linear length of the bill. By the time the length of the bill has passed between sensors 30 and 32, the electronic controller 46 will have determined whether the bill is a valid bill, or if there are two bills stuck together forming a double bill. At the time that the bill has completed its passage between sensors and 30 and 32, it will be in approximately the midpoint of the transport path 22 and the leading edge will have not yet reached lever sensor 40. As soon as the leading edge trips level sensor 40, in the event that a double bill or an invalid bill has been detected, the electronic controller 46 will shut off power to the linear displacement transducer 182 and the diverter levers 184 will rotate upwards so as to deflect the leading edge of the bill from transport path 22 into reject note path 48, the bill will be turned through a ninety degree rotation to proceed vertically downward into the reject note storage area 68.

When the sensor data from sensors 30 and 32 is interpreted by the electronic controller 46 as indicative of a valid note or secure script, then the diverter levers 184 will remain in the retracted position and the leading edge of the bill will exit through slot 20. Again, using the information from the motor encoder sensor 158 which senses the rotational position of the drive motor 150, the electronic controller 46 can calculate the proper length of time to power the drive motor 150 to allow the trailing edge of the bill being dispensed to advance to a point where it is held between drive roller 190 and tension roller 192. When the trailing edge of the bill is positioned between drive roller 190 and tension roller 192, the electronic controller 46 will shut off power to the drive motor 150 and the advancement of the bill will be stopped. The trailing edge of the bill will be held between drive roller 190 and tension roller 192. The user may then simply pull the bill from the machine to accept the dispensed bill. Once the trailing edge of the bill passes lever sensor 42, the lever sensor 42 will move to the open position and the electronic controller 46 can determine if another bill is to be dispensed. If so, the motors 124 and 150 can be activated and, as discussed above, the procedure for dispensing a bill is repeated.

When the tray 200 is reduced to a small number of bills or notes, such as approximately 10, the near-end optical sensor 282 sends a signal to the electronic controller 46 to activate a warning system. In addition, when the tray 200 is completely empty, the tray empty switch 280 sends a "tray empty" signal to the electronic controller 46. This information may then be communicated to the host machine 12 (FIG. 1).

The configuration of the note hopper 10 and the elements thereof are preferably designed to enhance security of the currency contained in the note hopper, including during transport of the currency cassette 18 when it is withdrawn from the note hopper 10. Thus, it should be noted that the system operates in a mode whereby only one bill is extracted from the currency cassette 18, it is then validated and, only if valid, dispensed by the note hopper 10. If for any reason the note is not validated by the information provided by optical sensors 30 and 32, it is simply diverted into the reject note storage area 68. By default, the electronic controller 46 must determine the bill should pass, otherwise it is automatically diverted to the reject note storage area 68.

The foregoing detailed description is provided to allow those skilled in the art to appreciate the present invention. It is contemplated, however, that such persons will readily understand the application of the note hopper detailed herein in various types of machines which are available. Therefore, the invention and protection afforded by this disclosure will properly be understood to be limited and defined only by the scope of the appended claims.

What is claimed is:

1. A note dispensing device comprising:

a note cassette having a note storage hopper for holding a plurality of notes;

a transport assembly including a note cassette bay for securely mounting said note cassette, said transport assembly including a note-extraction drive assembly for sequentially extracting said plurality of notes from said note cassette and a note advance assembly for transporting said notes through a note transport path to a note dispensing slot;

an electronic controller for controlling the operation of said note-extraction drive assembly and said note advance assembly of said transport assembly;

a rejected note storage area within said note cassette;

a rejected note transport assembly for accepting rejected notes from said note advance assembly and transporting said rejected notes to said rejected note storage area; and means for detecting the presence of a partially dispensed note from said transport path through said slot of said transport assembly.

2. The note dispensing device of claim 1, wherein said transport assembly further comprises a sensor electronically coupled to said electronic controller to detect the presence of a note partially dispensed from said transport path through said slot of said transport assembly.

3. A note cassette for use with a note dispensing device, said note cassette comprising:

a container for holding a plurality of notes;

a note-extract assembly for sequentially extracting said plurality of notes from said container;

a lid for covering said container;

a lock assembly for locking said lid to said container;

a rejected note storage area within said container; and a rejected note transport assembly for accepting rejected notes from said note-extract drive assembly and transporting said rejected notes to said rejected note storage area.

4. The note cassette of claim 3, wherein said lid further comprises an opening through which said notes are sequentially dispensed.

5. The note cassette of claim 4, wherein said locking assembly further comprises a plate assembly for securely covering said opening of said lid when said note cassette is removed from said note dispensing device.

6. The note cassette of claim 5, wherein said lid-further comprises:

a first opening through which said notes are sequentially dispensed; and a second opening through which said rejected notes are received from said note dispensing device.

7. The note cassette of claim 6, wherein said locking assembly further comprises a plate assembly for securely covering said first opening and said second opening of said lid when said note cassette is removed from said note dispensing device.

8. An electronic note dispensing apparatus comprising:

a note storage hopper for holding a plurality of notes;

a note-extraction drive assembly for sequentially extracting said plurality of notes from said note storage hopper;

a note advance assembly for receiving said notes from said note-extraction drive assembly and for transporting said notes to a note dispensing slot;

an electronic controller for controlling the operation of said note-extraction drive assembly and said note advance assembly;

a rejected note storage area;

a rejected note transport assembly for accepting rejected notes from said note advance assembly and transporting said rejected notes to said rejected note storage area; and a removable note cassette containing said note storage hopper.

9. The apparatus of claim 8, further comprising a means having at least one sensor electronically coupled to said electronic controller for sensing identifying characteristics of said notes and for providing signals indicative of said identifying characteristics of said notes to said electronic controller to detect unacceptable notes.

10. The note dispensing device of claim 8, wherein said transport assembly further comprises:

sensors for sensing identifying characteristics of notes advancing through said transport path and providing signals indicative of said identifying characteristics to said electronic controller;

a microprocessor in said electronic controller for processing signals from said sensors indicative of said identifying characteristics of said notes and comparing said processed signals to a set of stored signal parameters to determine the authenticity of notes advancing through said transport path; and a note diverted apparatus controlled by said electronic controller to divert non-authentic notes from said transport path to said rejected note storage area.

11. The note dispensing device of claim 8, wherein said transport assembly further comprises:

a position sensor electronically coupled to said electronic controller to detect a leading edge of a note extracted from said note cassette as said note enters said transport path of said transport assembly.

12. The note dispensing device of claim 8, wherein said transport assembly further comprises a sensor electronically coupled to said electronic controller, to detect the presence of a note partially dispensed from said transport path through said slot of said transport assembly.

13. A note dispensing device comprising:

a note cassette having a note storage hopper for holding a plurality of notes;

a transport assembly including a note cassette bay for securely mounting said note cassette, said transport assembly including a note-extraction drive assembly for sequentially extracting said plurality of notes from said note cassette and a note advance assembly for transporting said notes through a note transport path to a note dispensing slot;

an electronic controller for controlling the operation of said note-extraction drive assembly and said note advance assembly of said transport assembly;

a rejected note storage area within said note cassette;

a rejected note transport assembly for accepting rejected notes from said note advance assembly and transporting said rejected notes to said rejected note storage area; and means in said transport assembly for detecting multiple notes and unauthenticated notes and means for diverting the detected notes to said storage area.

* * * * *